US009618877B2

(12) United States Patent
Kusakabe et al.

(10) Patent No.: US 9,618,877 B2
(45) Date of Patent: Apr. 11, 2017

(54) IMAGE FORMING APPARATUS HAVING IMAGE FORMING UNITS FOR FORMING DEVELOPER IMAGES

(71) Applicant: Oki Data Corporation, Tokyo (JP)

(72) Inventors: Yoshiaki Kusakabe, Tokyo (JP); Teruaki Kuroda, Tokyo (JP); Masahiro Kawano, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/947,517

(22) Filed: Nov. 20, 2015

(65) Prior Publication Data

US 2016/0274487 A1 Sep. 22, 2016

(30) Foreign Application Priority Data

Mar. 20, 2015 (JP) ..... 2015-057317

(51) Int. Cl.
*G03G 15/06* (2006.01)
*G03G 15/08* (2006.01)
*G03G 15/00* (2006.01)

(52) U.S. Cl.
CPC ..... *G03G 15/065* (2013.01); *G03G 15/0812* (2013.01); *G03G 15/6585* (2013.01); *G03G 2215/0129* (2013.01)

(58) Field of Classification Search
CPC ..... G03G 15/08
See application file for complete search history.

(56) References Cited

U.S. PATENT DOCUMENTS 6,711,372 B1 * 3/2004 Noda ..... G03G 15/0806 399/234
2004/0146312 A1 * 7/2004 Saito ..... G03G 15/065 399/55
2010/0098446 A1 * 4/2010 Ishikawa ..... G03G 15/169 399/51

FOREIGN PATENT DOCUMENTS

JP 2014-032280 A 2/2014

OTHER PUBLICATIONS

JP_2014032280 Machine Translation, Japan, Feb. 2014, Mitsunobe.*

* cited by examiner

*Primary Examiner* — Clayton E Laballe
*Assistant Examiner* — Victor Verbitsky
(74) *Attorney, Agent, or Firm* — Rabin & Berdo, P.C.

(57) ABSTRACT

An image forming apparatus includes an image carrier for carrying an electrostatic latent image, a developer carrier for developing the electrostatic latent image of the image carrier with a developer, a developer regulating member that regulates a thickness of a layer of the developer held by the developer carrier, and a supply member that supplies the developer to the developer carrier. An absolute value of a voltage applied to the developer regulating member is larger than an absolute value of a voltage applied to the supply member.

17 Claims, 13 Drawing Sheets

FIG. 4

ID UNIT ARRANGEMENT TABLE

221

| POSITION | COLOR |
|---|---|
| S1 | K(BLACK) |
| S2 | Y(YELLOW) |
| S3 | M(MAGENTA) |
| S4 | C(CYAN) |
| S5 | W(WHITE) |

FIG. 5

SETTING TABLE

222

| POSITION／COLOR | BB[-V] (BLADE VOLTAGE) | SB[-V] (SUPPLY VOLTAGE) | DB[-V] (DEVELOPING VOLTAGE) | CH[-V] (CHARGING VOLTAGE) |
|---|---|---|---|---|
| S1 K(BLACK) | 135 | 285 | 205 | 1010 |
| S2 Y(YELLOW) | 150 | 300 | 200 | 1030 |
| S3 M(MAGENTA) | 230 | 380 | 200 | 1060 |
| S4 C(CYAN) | 150 | 300 | 170 | 1000 |
| S5 W(WHITE) | 550 | 430 | 230 | 965 |

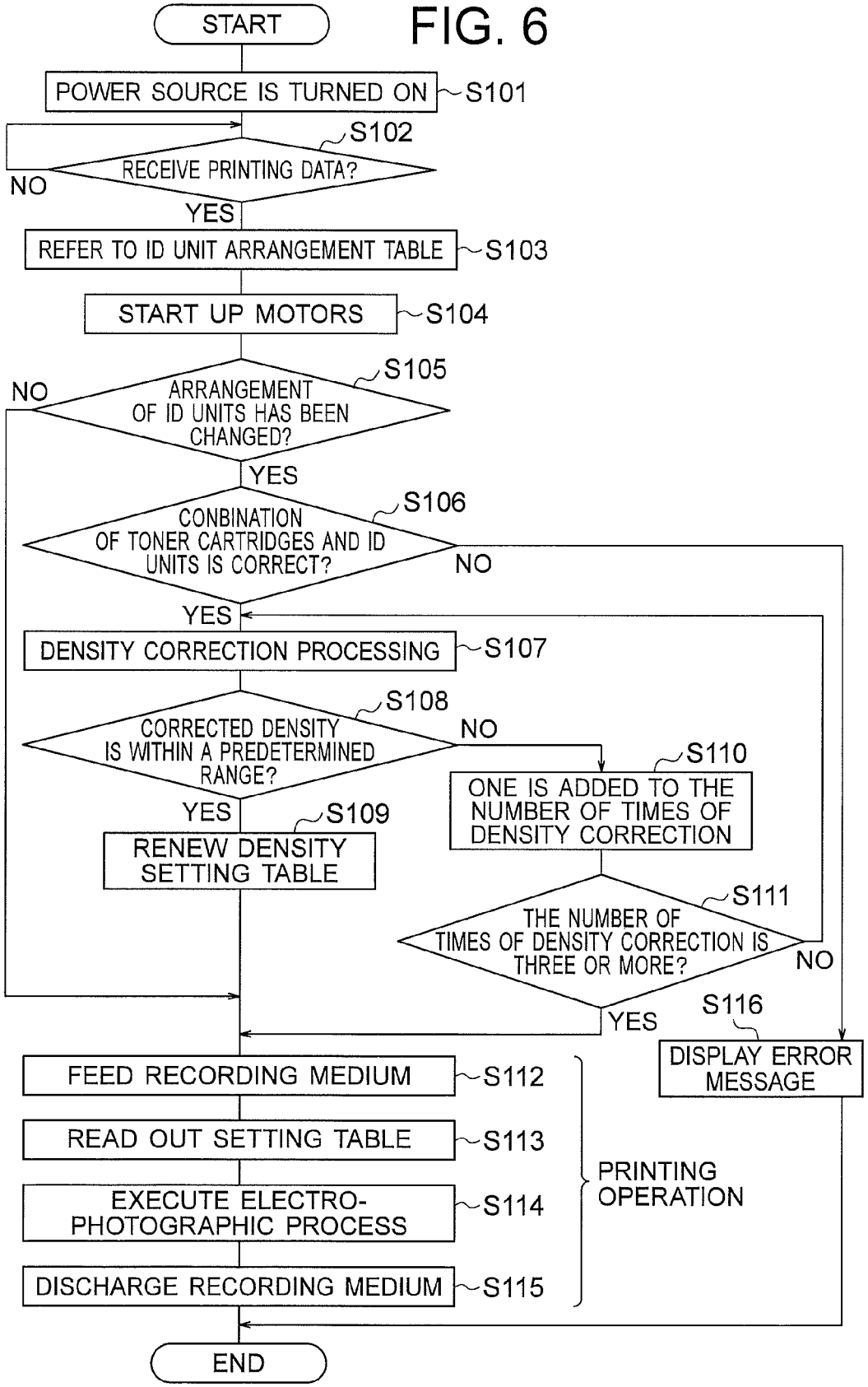
FIG. 6
START
POWER SOURCE IS TURNED ON
S101
S102
RECEIVE PRINTING DATA?
NO
YES
REFER TO ID UNIT ARRANGEMENT TABLE
S103
START UP MOTORS
S104
S105
ARRANGEMENT OF ID UNITS HAS BEEN CHANGED?
NO
YES
S106
CONBINATION OF TONER CARTRIDGES AND ID UNITS IS CORRECT?
NO
YES
DENSITY CORRECTION PROCESSING
S107
S108
CORRECTED DENSITY IS WITHIN A PREDETERMINED RANGE?
NO
YES
S110
ONE IS ADDED TO THE NUMBER OF TIMES OF DENSITY CORRECTION
S109
RENEW DENSITY SETTING TABLE
S111
THE NUMBER OF TIMES OF DENSITY CORRECTION IS THREE OR MORE?
NO
YES
S116
DISPLAY ERROR MESSAGE
FEED RECORDING MEDIUM
S112
READ OUT SETTING TABLE
S113
EXECUTE ELECTRO-PHOTOGRAPHIC PROCESS
S114
DISCHARGE RECORDING MEDIUM
S115
PRINTING OPERATION
END

| WHITE | | | | |
|---|---|---|---|---|
| BLADE VOLTAGE BB[-V] | SUPPLY VOLTAGE SB[-V] | FOGGING | SMEAR | OD VALUE (DENSITY OF WHITE 100%) |
| 430 | 430 | 9 | 9 | 0.35 |

FIG. 11

| WHITE | | | | |
|---|---|---|---|---|
| BLADE VOLTAGE BB[-V] | SUPPLY VOLTAGE SB[-V] | FOGGING | SMEAR | OD VALUE (DENSITY OF WHITE 100%) |
| 430 | 430 | 5 | 9 | 0.25 |

FIG. 13

| WHITE | | | | |
|---|---|---|---|---|
| BLADE VOLTAGE BB[-V] | SUPPLY VOLTAGE SB[-V] | FOGGING | SMEAR | OD VALUE (DENSITY OF WHITE 100%) |
| 550 | 550 | 9 | 5 | 0.25 |

FIG. 14

| WHITE | | | | |
|---|---|---|---|---|
| BLADE VOLTAGE BB[-V] | SUPPLY VOLTAGE SB[-V] | FOGGING | SMEAR | OD VALUE (DENSITY OF WHITE 100%) |
| 550 | 430 | 9 | 9 | 0.25 |

IMAGE FORMING APPARATUS HAVING IMAGE FORMING UNITS FOR FORMING DEVELOPER IMAGES

BACKGROUND OF THE INVENTION

1. Field of the Invention

The present invention relates to an image forming apparatus for forming an image by using an electrophotographic method.

2. Description of the Related Art

An image forming apparatus for forming an image by superimposing a white developer image and an another-colored developer image by using an electrophotographic method has been conventionally known. See, Japanese Patent Application Publication No. 2014-032280 (Patent Document 1), FIG. 2 and FIG. 5, for example.

It is difficult to charge a white developer in comparison with developers of other colors, since it contains a much amount of a metal oxide having relatively low electrical resistance. Accordingly, the white developer has properties that it is charged with polarity opposite to normal charge polarity, or that its charge amount is easy to become small. As a result, there is a case where a phenomenon called "fogging" in which the developer is stuck to an area where no image is supposed to be formed is caused.

SUMMARY OF THE INVENTION

The present invention is made to solve the problem described above, and an object of the present invention is to provide an image forming apparatus capable of suppressing generation of fogging.

An image forming apparatus according to the present invention includes an image carrier for carrying an electrostatic latent image, a developer carrier for developing the electrostatic latent image of the image carrier with a developer, a developer regulating member that regulates a thickness of a layer of the developer held by the developer carrier, and a supply member that supplies the developer to the developer carrier. An absolute value of a voltage applied to the developer regulating member is larger than an absolute value of a voltage applied to the supply member.

According to the present invention, by making a voltage applied to a developer regulating member larger than a voltage applied to a supply member, a developer charged with opposite polarity or a developer having a small charge amount can be normally charged. Therefore, generation of fogging can be suppressed.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 4 is a diagram showing an example of an ID unit arrangement table in the first embodiment;

FIG. 5 is a diagram showing an example of a setting table in the first embodiment;

FIG. 6 is a flowchart for explaining printing processing of the printer in the first embodiment;

FIG. 11 is a diagram showing results of evaluation of the fogging level and smear level of the white toner, and a result of measurement of the OD value of the white image at the printing duty of 100%, in a case where the blade voltage is −430 V and the supply voltage is −430 V in the white ID unit in the arrangement shown in FIG. 10;

FIG. 13 is a diagram showing results of evaluation of the fogging level and smear level of the white toner, and a result of measurement of the OD value of the white image at the printing duty of 100%, in a case where the blade voltage is −550 V and the supply voltage is −550 V in the white ID unit in the arrangement shown in FIG. 10;

FIG. 14 is a diagram showing results of evaluation of the fogging level and smear level of the white toner, and a result of measurement of the OD value of the white image at the printing duty of 100%, in a case where the blade voltage is −550 V and the supply voltage is −430 V in the white ID unit in the arrangement shown in FIG. 10.

DETAILED DESCRIPTION OF THE INVENTION

Further scope of applicability of the present invention will become apparent from the detailed description given hereinafter. However, it should be understood that the detailed description and specific examples, while indicating preferred embodiments of the invention, are given by way of illustration only, since various changes and modifications will become apparent to those skilled in the art from the detailed description.

<Whole Configuration of Printer>

Figure 1:
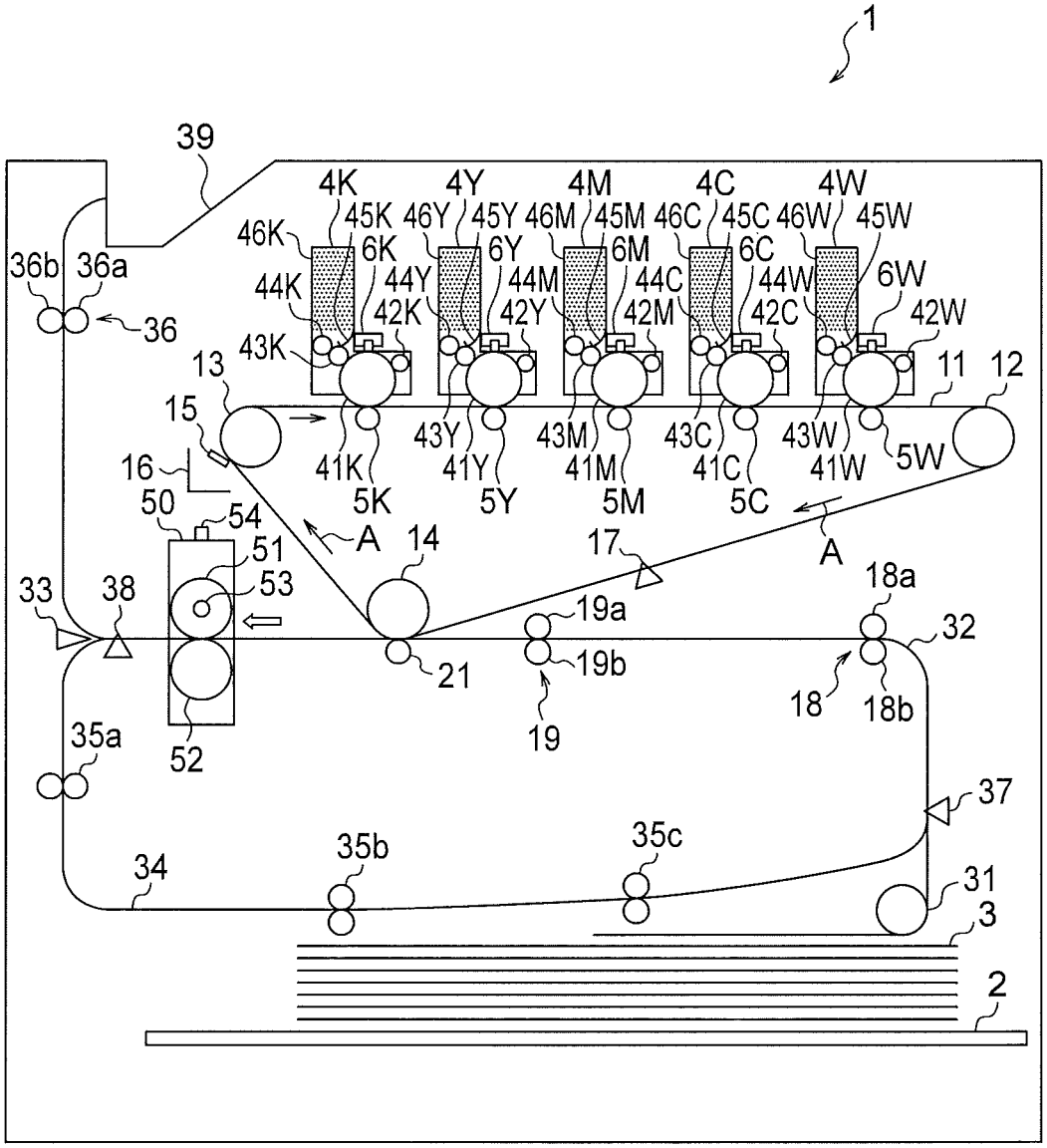
FIG. 1 is a diagram showing a configuration of a printer in a first embodiment of the present invention.

An embodiment of the present invention will be described below with reference to the drawings. FIG. 1 is a diagram showing a configuration of a printer 1 as an image forming apparatus in a first embodiment of the present invention. Here, the printer 1 is a color printer for forming an image by using an electrophotographic method. The printer 1 includes image drum units 4K, 4Y, 4M, 4C and 4W (hereinafter referred to as ID units) for forming toner images of black (K), yellow (Y), magenta (M), cyan (C) and white (W), respectively.

These ID units 4K, 4Y, 4M, 4C, and 4W are arranged in a line from the left side to the right side in FIG. 1. Moreover, the ID units 4K, 4Y, 4M, 4C, and 4W are detachably mounted to a main body of the printer 1. The ID units 4K, 4Y, 4M, 4C, and 4W are also referred to as image forming units (process units). Moreover, black, yellow, magenta, cyan, and white toners (developers) are also referred to as colored toners (colored developers).

Figure 3:
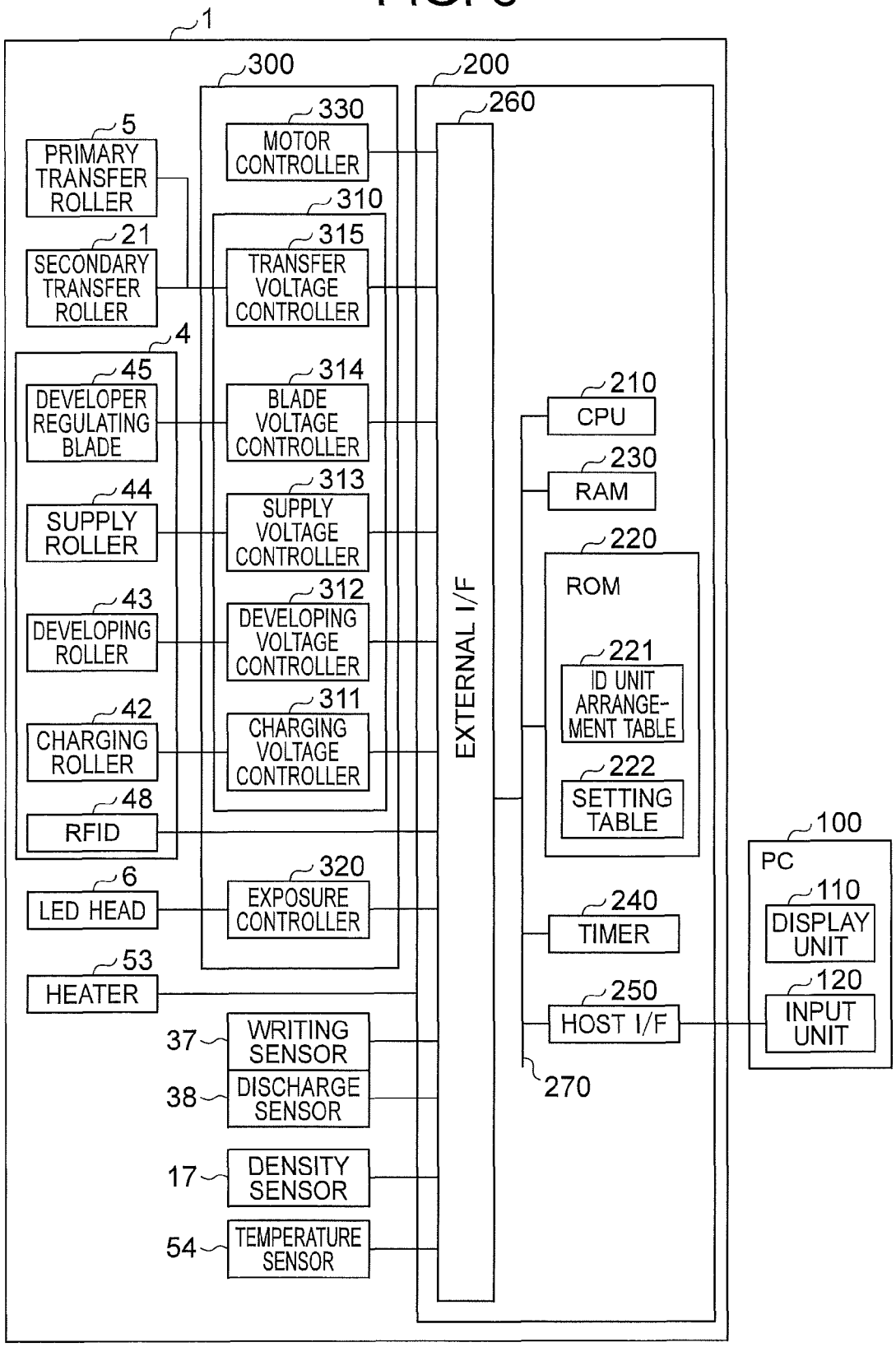
FIG. 3 is a block diagram showing a control system of the printer in the first embodiment.

LED heads 6K, 6Y, 6M, 6C, and 6W as exposure parts are arranged on the upper sides of the ID units 4K, 4Y, 4M, 4C, and 4W. The LED heads 6K, 6Y, 6M, 6C, and 6W radiate light to photosensitive drums 41K, 41Y, 41M, 41C, and 41W (which will be described later) respectively, and form electrostatic latent images. Moreover, light emissions from the LED heads 6K, 6Y, 6M, 6C, and 6W are controlled by an exposure controller 320 (FIG. 3).

An intermediate transfer belt 11 (transfer body) as an intermediate transfer member is arranged on the lower sides of the ID units 4K, 4Y, 4M, 4C, and 4W. The intermediate transfer belt 11 is an endless belt formed of a high-resistance semiconductive plastic film. The intermediate transfer belt 11 is stretched around a belt driving roller 12, a follower roller 13, and a secondary transfer backup roller 14.

Rotation of the belt driving roller 12 is controlled by a motor controller 330. The rotation of the belt driving roller 12 moves the intermediate transfer belt 11 in a direction indicated by arrows A in the figure. The follower roller 13 is biased in a direction apart from the belt driving roller 12 by a spring and gives tension to the intermediate transfer belt 11.

Primary transfer rollers 5K, 5Y, 5M, 5C, and 5W (primary transfer parts) are arranged so as to face the photosensitive drums 41K, 41Y, 41M, 41C, and 41W of the ID units 4K, 4Y, 4M, 4C, and 4W, respectively. The intermediate transfer belt 11 is held between primary transfer rollers 5K, 5Y, 5M, 5C, 5W and the photosensitive drums 41K, 41Y, 41M, 41C, 41W. A primary transfer voltage TR1 is applied to the primary transfer rollers 5K, 5Y, 5M, 5C, and 5W by a transfer voltage controller 315.

Toner images which have been formed on the photosensitive drums 41K, 41Y, 41M, 41C, and 41W of the ID units 4K, 4Y, 4M, 4C, and 4W by applying the primary transfer voltage TR1 are transferred to a surface (outer peripheral surfaces) of the intermediate transfer belt 11.

A secondary transfer roller 21 (secondary transfer part) is arranged so as to face the secondary transfer backup roller 14. The intermediate transfer belt 11 is held between the secondary transfer roller 21 and the secondary transfer backup roller 14. A secondary transfer voltage TR2 is applied to the secondary transfer roller 21 by the transfer voltage controller 315.

Toner images which have been transferred to the outer peripheral surface of the intermediate transfer belt 11 by applying the secondary transfer voltage TR2 are transferred to a recording medium 3 which passes between the secondary transfer roller 21 and the secondary transfer backup roller 14.

A cleaning blade 15 is arranged in a position which faces the follower roller 13. The intermediate transfer belt 11 is held between the follower roller 13 and the cleaning blade 15. The cleaning blade 15 is brought into contact with the outer peripheral surface of the intermediate transfer belt 11 to scrape off a stuck substance such as toner. A cleaner container 16 for accommodating the stuck substance such as toner that is scraped off by the cleaning blade 15 is provided on the lower side of the cleaning blade 15.

The printer 1 also includes a medium cassette 2 which accommodates the recording medium 3 such as printing paper sheets. Here, the medium cassette 2 is detachably mounted to a lower portion of the printer 1. A hopping roller 31 as a paper feeder is arranged on a paper feeding side (on an upper-right side in the figure) of the medium cassette 2. Rotation of the hopping roller 31 is controlled by the motor controller 330 (FIG. 3), and the hopping roller 31 sends off the recording medium 3 from the medium cassette 2 to a conveyance path 32.

A registration roller pair 18 consisting of a registration roller 18*a* and a pinch roller 18*b*, and a conveyance roller pair 19 consisting of a conveyance roller 19*a* and a pinch roller 19*b* is arranged along the conveyance path 32 for the recording medium 3.

The registration roller 18*a* rotates by control of the motor controller 330 (FIG. 3). The pinch roller 18*b* is brought into contact with the registration roller 18*a*, and rotates so as to follow the registration roller 18*a*. The registration roller 18*a* starts rotation at a predetermined timing after the recording medium 3 sent from the hopping roller 31 has been brought into contact with an abutment portion (nip portion) between the registration roller 18*a* and the pinch roller 18*b*. The registration roller pair 18 thus corrects skew of the recording medium 3 and conveys the corrected recording medium 3 along the conveyance path 32.

The conveyance roller 19*a* rotates under control of the motor controller 330 (FIG. 3). The pinch roller 19*b* is brought into contact with the conveyance roller 19*a* and rotates so as to follow the conveyance roller 19*a*. The conveyance roller pair 19 conveys the recording medium 3 which has been conveyed from the registration roller pair 18, along the conveyance path 32 toward the secondary transfer roller 21 (secondary transfer part).

A fixing unit 50 as a fixing part is disposed on the downstream side of the secondary transfer roller 21 along the conveyance path 32 of the recording medium 3. The fixing unit 50 includes a fixing roller 51 in which a heater 53 is built, a pressure roller 52 which is brought into contact with the fixing roller 51, and a temperature sensor 54 for detecting temperature of the fixing roller 51. By applying heat and pressure to the recording medium 3 with the fixing roller 51 and the pressure roller 52, toner on the recording medium 3 is fused and fixed onto the surface of the recording medium 3.

A discharge roller pair 36 for discharging the recording medium 3 to the outside of the printer 1 is arranged on the downstream side of the fixing unit 50 along the conveyance path 32 for the recording medium 3. The discharge roller pair 36 includes a discharge roller 36*a* and a pinch roller 36*b*. The discharge roller 36*a* rotates under control of the motor controller 330 (FIG. 3). The pinch roller 36*b* is brought into contact with the discharge roller 36*a* and rotates so as to follow the discharge roller 36*a*. The discharge roller pair 36 discharges the recording medium 3 on which fixing has been completed, to the outside of the printer 1. A stacker part 39 on which the discharged recording medium 3 is placed is provided in an upper portion of the printer 1.

Moreover, a selector (separator) 33 for switching the conveyance path for the recording medium 3 is provided on the downstream side of the fixing unit 50 along the conveyance path 32. The selector 33 serves to guide the recording medium 3 to a reconveyance path 34 in a duplex printing mode. The reconveyance path 34 serves to convey again to the secondary transfer roller 21 the recording medium 3 having the surface on which toner image is fixed, with the front and back sides of the recording medium 3 reversed. The reconveyance path 34 joins the conveyance path 32 on the upstream side with respect to the registration roller pair 18 described above. In addition, reconveyance roller pairs 35*a*, 35*b*, and 35*c* are arranged along the reconveyance path 34. Here, a detailed description about the reconveyance path 34 and the duplex printing mode is omitted.

A writing sensor 37 and a discharge sensor 38 which detect the passage of the recording medium 3 are disposed in the conveyance path 32 for the recording medium 3. The writing sensor 37 is disposed in the vicinity of the position where the reconveyance path 34 joins the conveyance path 32. The discharge sensor 38 is disposed in the vicinity of the selector 33. Each of the writing sensor 37 and the discharge sensor 38, for example, is a sensor equipped with a movable lever which fall down in contact with the recording medium 3.

<Configuration of ID Unit>

Next, configurations of the ID units 4K, 4Y, 4M, 4C, and 4W will be described. Since the ID units 4K, 4Y, 4M, 4C, and 4W have the common configuration except for the toner to be used, each of them is here referred to as "the ID unit 4".

Figure 2:
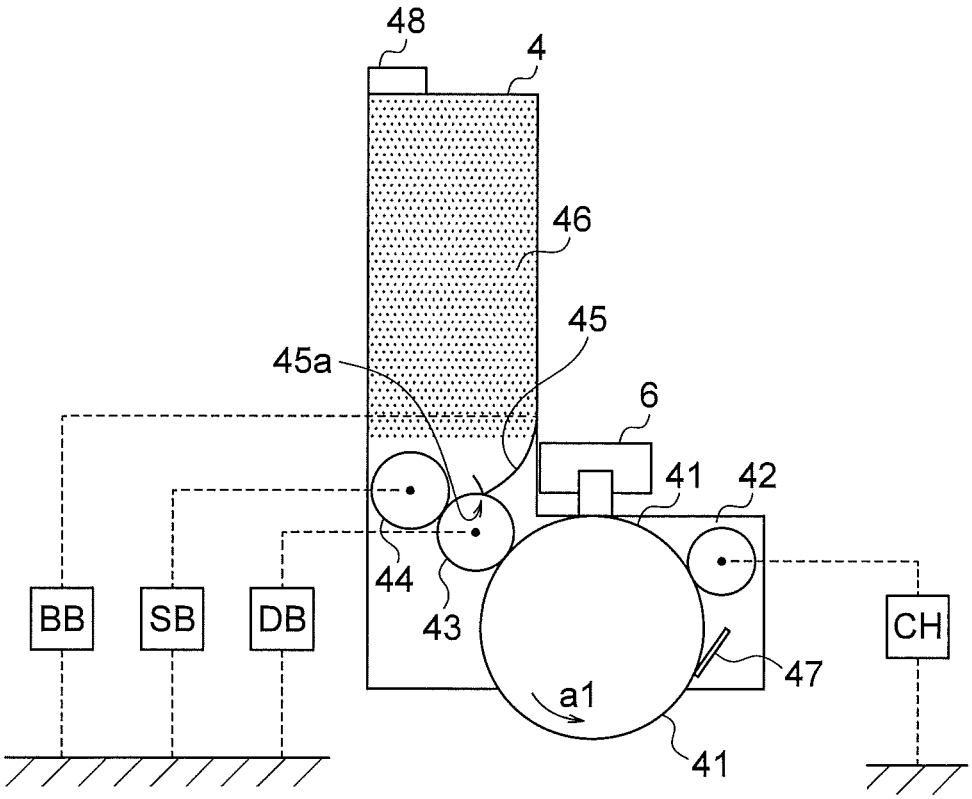
FIG. 2 is a diagram showing a configuration of an ID unit in the first embodiment.

FIG. 2 is an explanatory diagram showing the configuration of the ID unit 4. The ID unit 4 includes the photosensitive drum 41 (41K, 41Y, 41M, 41C, 41W) as an image carrier, a charging roller 42 (42K, 42Y, 42M, 42C, 42W) as a charging member, a developing roller 43 (43K, 43Y, 43M, 43C, 43W) as a developer carrier, a supply roller 44 (44K, 44Y, 44M, 44C, 44W) as a supply member, a developing blade 45 (45K, 45Y, 45M, 45C, 45W) as a developer regulating member, a toner cartridge 46 (46K, 46Y, 46M, 46C, 46W) as a developer container, and a cleaning blade 47 as a cleaning member.

The photosensitive drum 41, for example, is formed by laminating a photosensitive layer (a charge generating layer and a charge transport layer) on a surface of a cylindrical member made of a metal (e.g., aluminum). The photosensitive drum 41 rotates counterclockwise in the figure by a drum motor the rotation of which is controlled by the motor controller 330 (FIG. 3).

The charging roller 42, for example, is a roller which provides a semiconductive elastic layer (e.g., epichlorohydrin rubber) on a surface of a metallic shaft. The charging roller 42 is arranged so as to be brought into contact with the surface of the photosensitive drum 41, and rotates so as to follow the photosensitive drum 41. A charging voltage CH is applied to the charging roller 42 by a charging voltage controller 311 (FIG. 3), so that the charging roller 42 uniformly charges the surface of the photosensitive drum 41 with electricity. The surface of the photosensitive drum 41 which has been uniformly charged with electricity by the charging roller 42 is exposed by the LED head 6 (6K, 6Y, 6M, 6C, 6W) described above, and an electrostatic latent image is formed thereon.

The developing roller 43, for example, is a roller which provides a semiconductive elastic layer (e.g., urethane rubber) on a surface of a metallic shaft. The developing roller 43 is arranged so as to be brought into contact with the surface of the photosensitive drum 41, and rotates by rotation transmission from a drum motor. A developing voltage DB is applied to the developing roller 43 by a developing voltage controller 312 (FIG. 3). The developing roller 43 holds toner on its surface, causes the toner to stick to the electrostatic latent image formed on the surface of the photosensitive drum 41, and thereby develops the electrostatic latent image. Thus a toner image is formed.

The supply roller 44, for example, is a roller which provides an elastic layer (e.g., effervescent silicon rubber) on a surface of a metallic shaft. The supply roller 44 is arranged so as to be brought into contact with the surface of the developing roller 43 or spaced from it at a fixed distance, and rotates by the rotation transmission from the drum motor. A supply voltage SB is applied to the supply roller 44 by a supply voltage controller 313 (FIG. 3). The supply roller 44 supplies toner replenished from the toner cartridge 46 to the developing roller 43 and charges the toner with electricity.

The developing blade 45 is formed by bending a long plate member made of a metal (e.g., stainless steel) in a predetermined position in a width direction, for example. The developing blade 45 is disposed in such a way that its lengthwise direction is parallel with an axial direction of the developing roller 43, and the bent portion of the developing blade 45 is pressed against the surface of the developing roller 43. A blade voltage BB is applied to the developing blade 45 by a blade voltage controller 314 (FIG. 3). The developing blade 45 regulates a thickness of the toner layer stuck to the developing roller 43, and charges the toner with electricity.

The toner cartridge 46 is a container which is detachably mounted to the ID unit 4, and stores toner (developer). The toner cartridge 46 is arranged above the developing roller 43 and the supply roller 44, and replenishes the toner to the developing roller 43 and the supply roller 44.

The cleaning blade 47, for example, is a blade made of rubber and is disposed in such a way that its lengthwise direction is parallel with the axial direction of the photosensitive drum 41. The cleaning blade 47 presses its head portion against the surface of the photosensitive drum 41, and removes away toner remaining on the surface of the photosensitive drum 41.

A radio frequency identifier (RFID) 48 is an integrated circuit (IC) tag that is built in the ID unit 4. In the RFID 48, the color of toner of the ID unit 4 and identification information of the ID unit 4, and identification information (such as a serial number) of the toner cartridge 46, for example, are written.

<Control System of Printer>

FIG. 3 is a block diagram showing a control system of the printer 1. A personal computer (PC) 100 is connected to the printer 1. The PC 100 has a display unit 110 and an input unit 120.

The input unit 120, for example, is constituted of a keyboard, a mouse and the like. The input unit 120 is used so that a user creates an image of printing data by using an application or the like which is not shown in the drawing, and used so that a user inputs a response to an instruction transmitted from the printer 1. The display unit 110, for example, is a liquid crystal display or the like. The display unit 110 displays a printing image created by using the application which is not shown in the drawing, and displays the instruction transmitted from the printer 1.

A main controller 200 of the printer 1 includes a central processing unit (CPU) 210, a read only memory (ROM) 220, a random access memory (RAM) 230, a timer 240, a host interface (I/F) 250, and an external I/F 260. These components are connected through an internal bus 270.

The CPU 210 controls the RAM 230, the timer 240, the host I/F 250, and the external I/F 260 in accordance with a printing processing program stored in the ROM 220. Moreover, the CPU 210 controls a process controller 300 through the external I/F 260.

The ROM 220 is a region for storing the printing processing program and the like, and is a nonvolatile memory which can hold data even if the printer 1 is in a power-off state. An ID unit arrangement table 221 and a setting table 222 are stored in the ROM 220. The contents of the ID unit arrangement table 221 and the setting table 222 will be described later.

The RAM 230 is a volatile memory in which data is erased when the printer 1 is in the power-off state. The RAM stores printing data input from the PC 100. The RAM 230 also holds time information which is measured by the timer 240, and for determining timings of various controls.

The timer 240 measures time, and outputs the time which is measured to the CPU 210. The host I/F 250 performs transmission and reception of various control signals and printing data or the like between the PC 100 and the CPU 210. For example, the host I/F 250 receives a printing command and printing data transmitted from the PC100.

The external I/F 260 receives a density measurement result which is output from a density sensor 17, an output signal which is output from the writing sensor 37 and the discharge sensor 38 to indicate a conveyance position of the recording medium 3, and a signal which is output from the temperature sensor 54 in the fixing unit 50 to indicate a surface temperature of the fixing roller 51.

A process controller 300 controls a printing process (electrophotographic process) including conveyance of the recording medium 3, charging, developing, transferring, and fixing. The process controller 300 includes a high-voltage controller 310, the exposure controller 320 and the motor controller 330.

The high-voltage controller 310 controls a voltage applied to each of the rollers in order to transfer a toner image onto the recording medium 3. The high-voltage controller 310 includes a charging voltage controller 311, a developing voltage controller 312, a supply voltage controller 313, a blade voltage controller 314, and the transfer voltage controller 315.

The charging voltage controller 311 (charging voltage applying means) controls the charging voltage CH which is applied to the charging roller 42 (42K, 42Y, 42M, 42C, 42W).

The developing voltage controller 312 (developing voltage applying means) controls the developing voltage DB which is applied to the developing roller 43 (43K, 43Y, 43M, 43C, 43W).

The supply voltage controller 313 (supply voltage applying means) controls the supply voltage SB which is applied to the supply roller 44 (44K, 44Y, 44M, 44C, 44W).

The blade voltage controller 314 (developer-regulating-member voltage applying means) controls the blade voltage BB which is applied to the developing blade 45 (45K, 45Y, 45M, 45C, 45W).

The transfer voltage controller 315 (transfer voltage applying means) controls the primary transfer voltage TR1 which is applied to the primary transfer roller 5 (5K, 5Y, 5M, 5C, 5W), and the secondary transfer voltage TR2 which is applied to the secondary transfer roller 21.

The exposure controller 320 controls light emission of the LED heads 6K, 6Y, 6M, 6C, and 6W. The exposure controller 320 is provided for each of the LED heads 6K, 6Y, 6M, 6C, and 6W, and it is shown as a single block in FIG. 3.

The motor controller 330 controls rotation of each of the motors in the printer 1. Specifically, the motor controller 330 controls rotation of each of the drum motors (not shown in the drawing) for rotating the photosensitive drums 41 (41K, 41Y, 41M, 41C, and 41W). Rotation of the drum motor causes the photosensitive drum 41 to rotate in a direction represented by an arrow al in FIG. 2. Moreover, rotation of each of the drum motors is transmitted through a gear provided in an end portion of each shaft of the developing roller 43 and the supply roller 44, and thereby the developing roller 43 and the supply roller 44 rotate.

The motor controller 330 also controls rotation of each of the motors which rotates the belt driving roller 12, the hopping roller 31, the registration roller 18*a*, the conveyance roller 19*a*, the selector 33, the discharge roller 36*a*, and the pressure roller 52.

<ID Unit Arrangement Table and Setting Table>

Next, a description will be given with respect to the ID unit arrangement table 221 and the setting table 222 which are stored in the ROM 220. The ID unit arrangement table 221 stores an arrangement of the ID units 4 (4K, 4Y, 4M, 4C, and 4W) used when the process controller 300 controls each component.

FIG. 4 is a diagram showing an example of the ID unit arrangement table 221. FIG. 4 shows a setting example in a case where the ID units 4K, 4Y, 4M, 4C, and 4W are arranged along a direction of movement of the intermediate transfer belt 11 (from the left to the right in FIG. 1).

As shown in FIG. 4, when positions of the ID units 4 along the direction of the movement of the intermediate transfer belt 11 are represented as positions S1, S2, S3, S4, and S5, respectively, the ID unit arrangement table 221 stores the positions S1, S2, S3, S4, and S5 associated with the ID units 4K, 4Y, 4M, 4C, and 4W of black (K), yellow (Y), magenta (M), cyan (C), and white (W), respectively.

On the other hand, the setting table 222 stores parameters which are used when the process controller 300 controls each component. FIG. 5 shows an example of the setting table (voltage setting table) 222 relating to the blade voltage BB, the supply voltage SB, the developing voltage DB, and the charging voltage CH.

For example, with respect to the ID unit 4K (black) in the position S1, −135 V, −285 V, −205 V, and −1010 V are stored as the blade voltage BB, the supply voltage SB, the developing voltage DB, and the charging voltage CH, respectively.

With respect to the ID unit 4Y (yellow) in the position S2, −150 V, −300 V, −200 V, and −1030 V are stored as the blade voltage BB, the supply voltage SB, the developing voltage DB, and the charging voltage CH, respectively.

With respect to the ID unit 4M (magenta) in the position S3, −230 V, −380 V, −200 V, and −1060 V are stored as the blade voltage BB, the supply voltage SB, the developing voltage DB, and the charging voltage CH, respectively.

With respect to the ID unit 4C (cyan) in the position S4, −150 V, −300 V, −170 V, and −1000 V are stored as the blade voltage BB, the supply voltage SB, the developing voltage DB, and the charging voltage CH, respectively.

With respect to the ID unit 4W (white) in the position S5, −550 V, −430 V, −230 V, and −965 V are stored as the blade voltage BB, the supply voltage SB, the developing voltage DB, and the charging voltage CH, respectively.

<Operation of Printer>

Next, a description will be given with respect to printing processing of the printer 1 configured as described above. FIG. 6 is a flowchart for explaining the printing processing of the printer 1. The flowchart is executed by the control of the CPU 210 of a main controller 200.

When the power source of the printer 1 is turned ON (Step S101), the CPU 210 proceeds to an on-line state in which it is possible to receive printing data from the PC 100 (Step S102).

When receiving printing data from the PC 100 (YES in Step S102), the CPU 210 stores the printing data in the RAM 230. The CPU 210 also reads out toner color information, which is on the color of the toner, of the respective ID units 4 from the RFIDs 48 mounted to the respective ID units 4, and refers to the ID unit arrangement table 221 stored in the ROM 220 (Step S103).

The CPU 210 then causes to rotate the photosensitive drum 41, the belt driving roller 12, and the pressure roller 52 by the motor controller 330 (Step S104). The CPU 210 also starts heating control of the heater 53 of the fixing roller 51.

Next, the CPU 210 compares the toner color information of the respective ID units 4 which is read out from the RFIDs 48 in Step S103, and the ID unit arrangement table stored in the ROM 220, and judges whether or not the arrangement of the ID units 4K, 4Y, 4M, 4C, and 4W has been changed (Step S105). When the arrangement of the ID units 4K, 4Y, 4M, 4C, and 4W has not been changed (NO in Step S105), process proceeds to Step S112 and printing operation is carried out.

When the arrangement of the ID units 4K, 4Y, 4M, 4C, and 4W has been changed (YES in Step S105), it is judged whether or not a combination of the toner cartridges 46 and the ID units 4 is a correct combination (Step S106). For example, identification information of the ID units 4 and identification information of the toner cartridges 46 are read out from the RFIDs 48, and it is judged whether or not they are the correct combination.

If the combination of the toner cartridges 46 and the ID units 4 is not the correct combination (NO in Step S106), an error message (alarm) is displayed (Step S116).

If the combination of the toner cartridges 46 and the ID units 4 is the correct combination (YES in Step S106), the CPU 210 executes density correction processing (Step S107).

Specifically, the CPU 210 forms patterns for density correction of black, magenta, yellow, cyan, and white on the surface of the intermediate transfer belt 11 through the process controller 300. That is to say, the surfaces of the photosensitive drums 41K, 41Y, 41M, 41C, and 41W are uniformly charged with electricity by the charging rollers 42K, 42Y, 42M, 42C, and 42W, respectively, and are irradiated with light from the LED heads 6K, 6Y, 6M, 6C, and 6W, and thus electrostatic latent images are formed. Moreover, the electrostatic latent images on the surfaces of the photosensitive drums 41K, 41Y, 41M, 41C, and 41W are developed by the developing rollers 43K, 43Y, 43M, 43C, and 43W to form toner images of the respective colors (patterns for density correction), and the formed images are transferred onto the surface of the intermediate transfer belt 11 by the primary transfer rollers 5K, 5Y, 5M, 5C, and 5W. Then, the density sensor 17 detects density of the patterns for density correction of the respective colors on the surface of the intermediate transfer belt 11

As the result of the detection by the density sensor 17, if any of the patterns for density correction of the respective colors has density which is lower than a predetermined range, in the ID unit 4 of the corresponding color the developing voltage DB is increased by a predetermined amount, and another pattern for density correction is newly formed on the surface of the intermediate transfer belt 11. On the other hand, as the result of the detection, if any of the patterns for density correction has density which is higher than the predetermined range, in the ID unit 4 of the corresponding color the developing voltage DB is decreased by a predetermined amount, and another pattern for density correction is newly formed on the surface of the intermediate transfer belt 11.

Next, the CPU 210 causes the density sensor 17 to detect the density of the patterns for density correction of the respective colors formed on the surface of the intermediate transfer belt 11, thereby judging whether or not the detected density of the patterns for density correction of the respective colors is within a predetermined range (Step S108). If they are within the predetermined range (YES in Step S108), a density correction value is added to a current setting value (density setting value) (Step S109).

The density setting value is obtained from a combination of an initial value determined according to the kind and thickness of the recording medium 3 and a printing speed, a temporal correction value determined according to a status of use of the photosensitive drum 41, and an environment correction value determined according to ambient temperature and humidity. These values are stored in the ROM 220 in table form. A detailed description about the density setting is omitted here.

As the result of the detection by the density sensor 17, if the density of the patterns for density correction of the respective color is not within the predetermined range (NO in Step 108), one is added to a variable N representing the number of times of the density correction (Step S110), and it is judged whether or not the number (N) of times of the density correction is three or more (Step S111). If the number (N) of times of the density correction is less than three (NO in Step S111), the processing from Steps S107 to S108 is repeated. If the number (N) of times of the density correction reaches three (YES in Step S111), the process proceeds to Step S112 and shifts to printing operation.

In Step S112, the CPU 210 rotates the hopping roller 31 through the motor controller 330 to feed the recording medium 3 from the medium cassette 2. Moreover, the CPU 210 rotates the registration roller 18*a* and the conveyance roller 19*a* through the motor controller 330 to convey the recording medium 3 along the conveyance path 32.

Next, the CPU 210 reads out each setting table from the ROM 220 (Step S113), and applies the charging voltage CH, the developing voltage DB, the supply voltage SB, and the blade voltage BB to the charging roller 42, the developing roller 43, the supply roller 44, and the developing blade 45 in each of the ID units 4 (4K, 4Y, 4M, 4C, and 4W), respectively, through the charging voltage controller 311, the developing voltage controller 312, the supply voltage controller 313 and the blade voltage controller 314 (Step S114).

Moreover, when the top end of the recording medium 3 fed from the medium cassette 2 is detected by the writing sensor 37, the CPU 210 reads out printing data of the respective colors from the RAM 230 and successively starts control of light emission of the LED head 6K, 6Y, 6M, 6C, and 6W through the exposure controller 320. Herewith, electrostatic latent images of the respective colors are thus formed on the surfaces of the photosensitive drums 41K, 41Y, 41M, 41C, and 41W.

In each of the ID units 4 (4K, 4Y, 4M, 4C, and 4W), toner which has been replenished from the toner cartridge 46 is supplied to the surface of the developing roller 43 by the supply roller 44. A toner layer having a given thickness is formed on the surface of the developing roller 43 by the developing blade 45. The toner on the surface of the developing roller 43 is charged in a predetermined polarity (negative polarity here) by the actions of the supply roller 44 and the developing blade 45. The electrostatic latent image on the surface of the photosensitive drum 41 is developed with the toner on the surface of the developing roller 43, and thus the toner image is formed.

Next, the CPU 210 applies the primary transfer voltage TR1 to the primary transfer rollers 5K, 5Y, 5M, 5C, and 5W through the transfer voltage controller 315. Herewith, the toner images of the respective colors on the surfaces of the photosensitive drums 41K, 41Y, 41M, 41C, and 41W are successively transferred onto the surface of the intermediate transfer belt 11.

Moreover, the CPU 210 applies the secondary transfer voltage TR2 to the secondary transfer roller 21 through the transfer voltage controller 315. The toner image on the surface of the intermediate transfer belt 11 is transferred onto the recording medium 3 when the recording medium 3 which is conveyed by the registration roller pair 18 and the conveyance roller pair 19 passes through the nip portion between the secondary transfer roller 21 and the secondary transfer backup roller 14.

The recording medium 3 onto which the toner image has been transferred is conveyed to the fixing unit 50. In the fixing unit 50, by applying heat and pressure to the toner image in a nip portion (fixing nip portion) between the fixing roller 51, which is heated up to a predetermined temperature by the heater 53 in advance, and the pressure roller 52, the toner image is fixed onto the recording medium 3. The recording medium 3 onto which the toner image has been fixed is further conveyed by rotation of the pressure roller 52.

When the top end of the recording medium 3 has been detected by the discharge sensor 38, the CPU 210 rotates the discharging roller 36*a* through the motor controller 330 to discharge the recording medium 3 to the outside of the printer 1 (Step S115). The recording medium 3 which is discharged is placed on the stacker part 39 which is provided in the upper portion of the printer 1. Thus the image forming operation is completed.

<Action for Suppressing Fogging>

Next, an action for suppressing fogging in the present embodiment will be described. Fogging is a phenomenon in which a developer is stuck to an area where no image is supposed to be formed. Fogging is caused by oppositely charged toner (toner charged in a polarity opposite to an original charge polarity) and toner having a small charge amount. For this reason, these oppositely charged toner and toner having a small charge amount are referred to as fogging toner.

White toner contains a material having low-electrical resistance (hereinafter referred to as a low-resistance material) such as a metallic oxide (e.g., titanium dioxide) as a coloring agent. On the other hand, toners of black (K), yellow (Y), magenta (M), and cyan (C) contain materials having high-electrical resistance, such as a carbon black, a pigment yellow, a pigment magenta, and a pigment cyan, as coloring agents, for example.

Thus the white toner contains a high content of a low resistance material in comparison with the toners of the other colors, therefore the white toner has the property of being harder to be charged in comparison with the toners of the other colors. Accordingly, with respect to the white toner, oppositely charged toner and toner having a small charge amount (i.e., fogging toner) are frequently generated. For this reason, it is necessary to suppress generation of white fogging toner.

Figure 7:
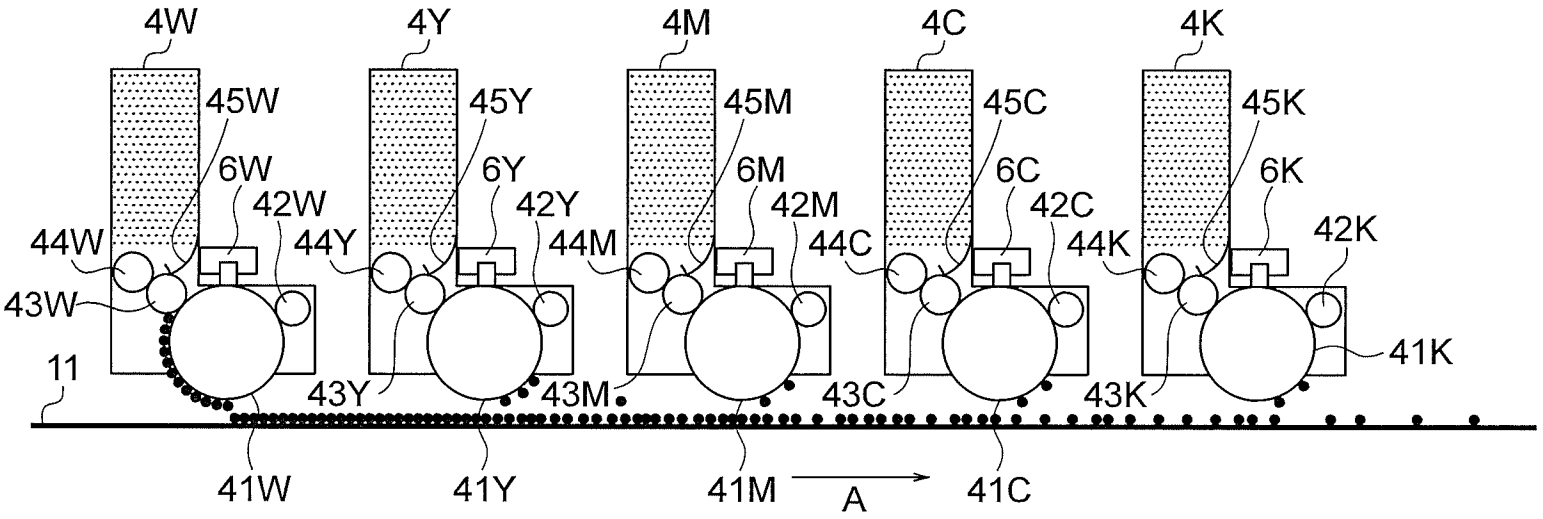
FIG. 7 is a diagram showing an example of arrangement of the ID units.

FIG. 7 is a schematic diagram showing a transfer state of the white fogging toner onto the intermediate transfer belt 11 in a case where the ID units 4W, 4Y, 4M, 4C, and 4K are arranged in this order along the direction of movement of the intermediate transfer belt 11 (arrow A) (that is, in a case where the ID unit 4W is arranged on the most upstream side). Here, normal charge polarity of toner is supposed to be negative polarity.

In the arrangement shown in FIG. 7, since the ID unit 4W is arranged on the most upstream side, the amount of the white fogging toner transferred from the ID unit 4W onto the intermediate transfer belt 11 is reduced as the intermediate transfer belt 11 passes through the ID units 4Y, 4M, 4C, and 4K.

This is because negative charges are generated on the surfaces of the photosensitive drums 41 of the ID units 4Y, 4M, 4C, and 4K and the positive primary transfer voltage is applied to each of the primary transfer rollers 5Y, 5M, 5C, and 5K (which are omitted in FIG. 7), and therefore the white fogging toner which is positively charged (i.e., oppositely charged) or has a small charge amount is easily adsorbed on the surfaces of the photosensitive drums 41 of the ID units 4Y, 4M, 4C, and 4K.

Figures 8, 9:
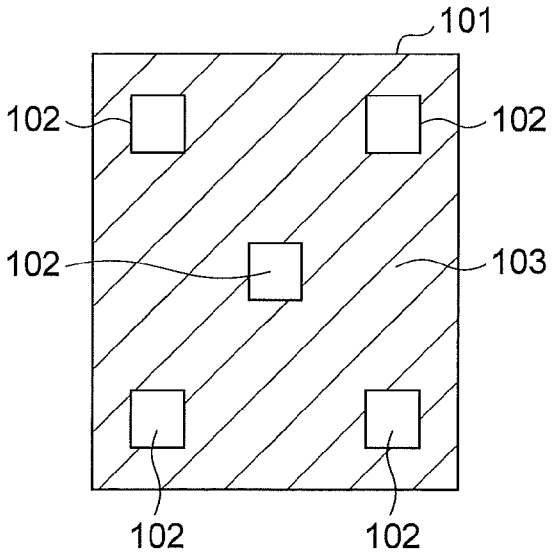
FIG. 8 is a diagram showing results of evaluation of fogging level and smear level of white toner, and a result of measurement of an OD value of a white image at a printing duty of 100%, in a case where a blade voltage is −430 V and a supply voltage is −430 V in a white ID unit in the arrangement shown in FIG. 7.
FIG. 9 is a schematic diagram for explaining a test pattern used for the evaluation of the fogging level and smear level.

FIG. 8 shows results of evaluation of fogging level and smear level of the white toner on the intermediate transfer belt 11, in a case where the blade voltage BB of −430 V is applied to the developing blade 45W and the supply voltage SB of −430 V is applied to the supply roller 44W in the ID unit 4W, in the arrangement shown in FIG. 7.

The charging voltage CH applied to the charging roller 42W and the developing voltage DB applied to the developing roller 43W in the ID unit 4W are as shown in FIG. 5. The voltages applied to the respective rollers in the ID units 4K, 4Y, 4M, and 4C other than the ID unit 4W for white are also as shown in FIG. 5.

Methods of evaluating the fogging level and the smear level are as follows. Firstly, a test pattern was printed on a blue sheet (recording medium) with a white toner by using the printer 1. A colored fine paper (blue color) manufactured by Hokuetsu Kishu Paper Co., Ltd. was used as the blue sheet. A size of the sheet is an A3 wide size (328 mm×453 mm), and a weight of the sheet is 80 kg when the size of the sheet is converted to the duodecimo-size (1091 mm×788 mm). It is noted that the weight of the sheet means the weight of piled up 1000 sheets.

FIG. 9 is a schematic diagram showing the test pattern printed on the blue sheet. In this case, substantially square-shaped and white test patterns (denoted by reference character 102 in FIG. 9) were printed on the five places in total of the four corners and the center of the blue sheet (denoted by reference character 101 in FIG. 9).

The test pattern 102 was printed on the sheet 101 and then the state of sticking of the white toner in a portion other than the test pattern 102 (i.e., non-printed portion) was checked. If the sticking of the white toner could not be visually recognized, it was defined as level 10; if the sticking of the white toner was remarkably recognized, it was defined as level 1. Moreover, the intermediate sticking state between level 1 and level 10 was classified into levels 2 to 9 according to the degree. Judgment from levels 1 to 10 was carried out by comparing with a sample prepared in advance.

Fogging and smear are common in a point that the developer (toner) is stuck to an area in which no image is supposed to be formed. However, there is a difference between fogging and smear: fogging is caused by oppositely charged toner or toner having a small charge amount and it makes the density of the printed portion (test pattern 102 in FIG. 9) thinner than a predetermined density, while smear is caused by overcharged toner and it makes the density of the printed portion thicker than the predetermined density. Therefore, the fogging level and smear level were judged according to the toner sticking state in the non-printed portion 103 described above and the density of the test pattern 102.

With respect to both of fogging and smear, level 9 and the higher level were defined as acceptable levels (levels which are practically free from a problem), and level 8 and the lower levels were defined as unacceptable levels.

Moreover, a white image (solid image) having a printing duty of 100% was formed on the recording medium 3 and its optical density (OD) value was measured. In FIG. 8, the result of the measurement of the OD value is shown as well. For the measurement of the OD value, a spectral density meter "X-Rite" (manufactured by X-Rite Inc.) was used. The OD value which is 0.3 or less was recognized as acceptable, and the OD value which is more than 0.3 was recognized as unacceptable.

In the result shown in FIG. 8, both the fogging level and smear level are level 9, that is, an acceptable level. However, the OD value of the white image having the printing duty of 100% is 0.35, that is, an unacceptable level. It means that the density of the white image is low.

Figure 10:
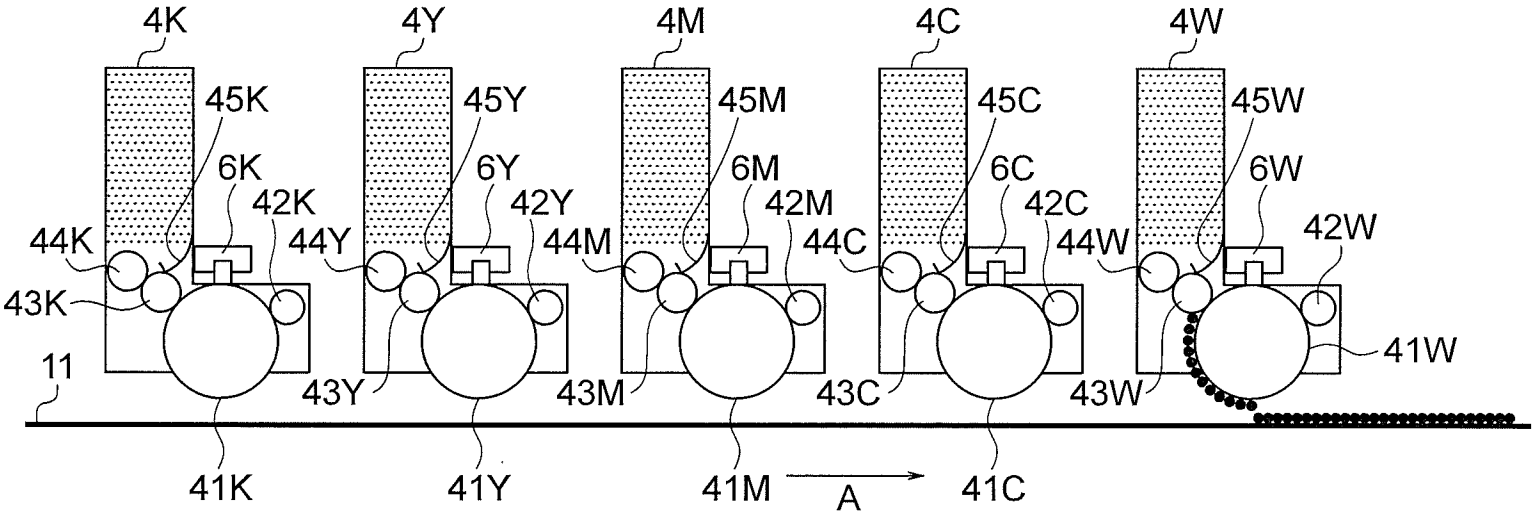
FIG. 10 is a diagram showing an example of arrangement of the ID units in the first embodiment.

In order to improve a density of a white image, a configuration in which the ID unit 4W is arranged most downstream is effective. FIG. 10 is a schematic diagram showing a state of transfer of the white fogging toner onto the intermediate transfer belt 11 in a case where the ID units 4K, 4Y, 4M, 4C, and 4W are arranged in this order along the direction of movement (arrow A) of the intermediate transfer belt 11 (that is, in a case where the ID unit 4W is arranged on the most downstream side).

In the arrangement shown in FIG. 10, since there is no ID unit on the downstream side from the white ID unit 4W, the white fogging toner transferred from the ID unit 4W onto the intermediate transfer belt 11 still remains on the surface of the 0intermediate transfer belt 11.

FIG. 11 shows results of evaluation for the fogging level and smear level of the white toner on the intermediate transfer belt 11, and a result of measurement of the OD value of the white image having the printing duty of 100%, in a case where the blade voltage BB of −430 V is applied to the developing blade 45W and the supply voltage SB of −430 V is applied to the supply roller 44W in the ID unit 4W, in the arrangement shown in FIG. 10.

The charging voltage CH applied to the charging roller 42W and the developing voltage DB applied to the developing roller 43W in the ID unit 4W are as shown in FIG. 5. The voltages applied to the respective rollers in the ID units 4K, 4Y, 4M, and 4C for the colors other than white are also as shown in FIG. 5.

In the results shown in FIG. 11, the OD value of the white image having the printing duty of 100% is 0.25, that is, an acceptable level. Moreover, the smear level is level 9, that is, an acceptable level. However, the fogging level is level 5, that is, an unacceptable level. This is because the white fogging toner generated in the ID unit 4W is not adsorbed on the photosensitive drums 41K, 41Y, 41M, and 41C of the ID units 4K, 4Y, 4M, and 4C of the other colors. Therefore, it is understood that it is necessary to suppress the white fogging toner generated in the ID unit 4W in the arrangement shown in FIG. 10.

Figure 12:
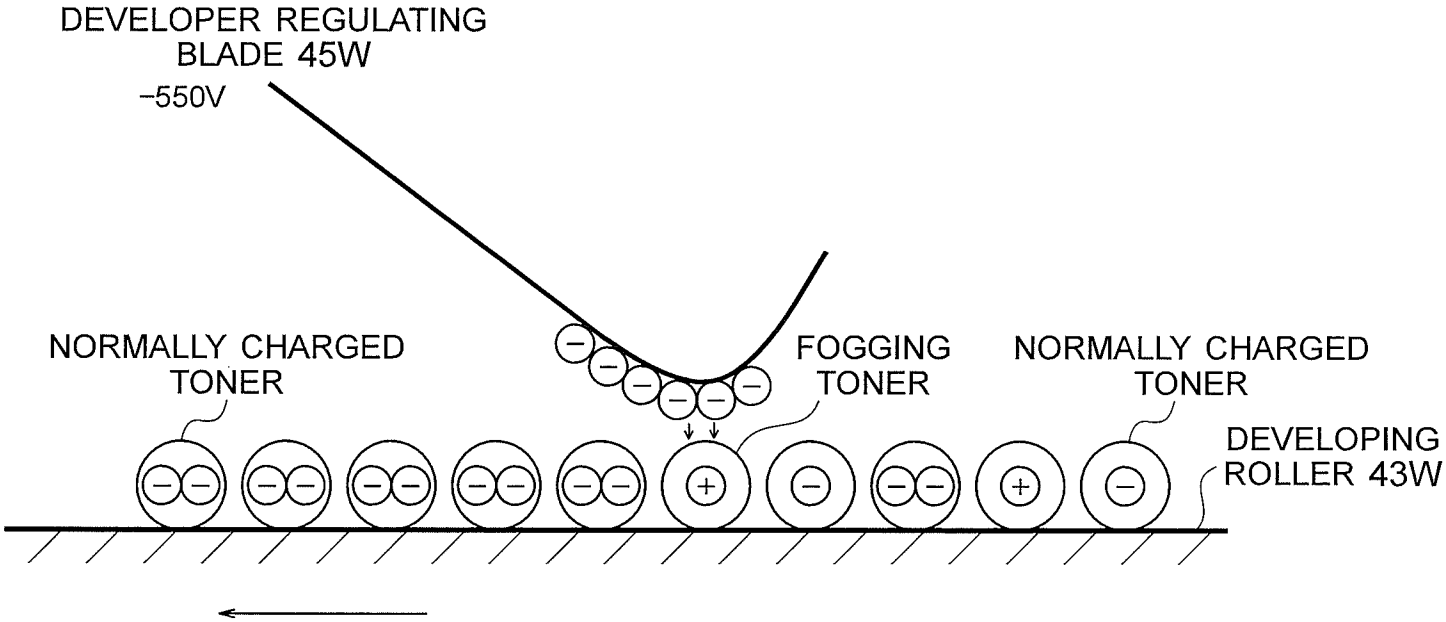
FIG. 12 is a schematic diagram showing an action which causes fogging toner on a developing roller to be normally charged by a developer regulating blade.

FIG. 12 is a schematic diagram showing behavior that the developing blade 45W, which has a high voltage and the same polarity (negative) as the normally charged toner (negative), causes the fogging toner (oppositely charged toner (positive) or toner having a small charge amount (negative)) on the surface of the developing roller 43W to be normally charged.

In the present embodiment, a high voltage of the same polarity as the normal charge polarity of the toner (negative polarity in FIG. 12) is applied to the developing blade 45W. This makes it possible to inject a charge into the fogging toner from the developing blade 45W, when the developing blade 45W regulates the thickness of the toner layer (toner amount) on the surface of the developing roller 43W. That is, generation of fogging can be suppressed by charging the fogging toner to a normal charge amount and thus changing it to normally charged toner.

Here, as a method of injecting a charge into the fogging toner, it is also conceivable to inject a charge into the fogging toner, when a high voltage is applied to the supply roller 44 and toner is supplied to the developing roller 43 from the supply roller 44.

However, if a high voltage is applied to the supply roller 44, since an amount of toner supplied from the supply roller 44 to the developing roller 43 increases, there is a possibility that overcharged toner is generated and it causes the smear described above.

FIG. 13 shows results of evaluation of the fogging level and smear level of the white toner on the intermediate transfer belt 11, and a result of measurement of the OD value of the white image having the printing duty of 100%, in a case where the blade voltage BB of −550 V is applied to the developing blade 45W and the supply voltage SB of −550 V is applied to the supply roller 44W in the ID unit 4W, in the arrangement shown in FIG. 10.

The charging voltage CH applied to the charging roller 42W and the developing voltage DB applied to the developing roller 43W in the ID unit 4W are as shown in FIG. 5. The voltages applied to the respective rollers in the ID units 4K, 4Y, 4M, and 4C for the colors other than white are also as shown in FIG. 5.

In the measurement results shown in FIG. 13, the fogging level of the white toner is level 9, that is, an acceptable level. However, the smear level is level 5, that is, an unacceptable level.

Therefore, in the present embodiment, an absolute value of the blade voltage BB which is applied to the developing blade 45W is made larger than an absolute value of the supply voltage SB which is applied to the supply roller 44W. For example, the blade voltage BB is set to −550 V the absolute value of which is larger than that of the supply voltage SB (−430 V).

Thus, it is possible to suppress generation of smear by suppressing toner supply from the supply roller 44 to the developing roller 43 to the degree that no overcharged toner is generated, while it is possible to reduce generation of fogging by increasing charge injection from the developing blade 45 to the toner and thus changing the fogging toner to normally charged toner.

FIG. 14 shows results of evaluation for the fogging level and smear level of the white toner on the intermediate transfer belt 11, and a result of measurement of the OD value of the white image having the printing duty of 100%, in a case where the blade voltage BB of −550 V is applied to the developing blade 45W and the supply voltage SB of −430 V is applied to the supply roller 44W in the ID unit 4W, in the arrangement shown in FIG. 10.

In the measurement results shown in FIG. 14, both the fogging level and smear level of the white toner are level 9, that is, an acceptable level. In addition, the OD value of the white image having the printing duty of 100% is 0.25, that is, an acceptable level.

Thus, by making the absolute value of the blade voltage BB applied to the developing blade 45W larger than the absolute value of the supply voltage SB applied to the supply roller 44W in the ID unit 4W, it is possible to suppress fogging and smear of the white toner.

Here, a value obtained by subtracting the absolute value of the supply voltage SB applied to the supply roller 44W from the absolute value of the blade voltage BB applied to the developing blade 45W in the ID unit 4W for white is |−550 V|−|−430 V|=120 V.

On the other hand, in the ID unit 4K for black, a value obtained by subtracting the absolute value of the supply voltage SB from the absolute value of the blade voltage BB is |−135 V|−|−285 V|=−150 V. In the ID unit 4Y for yellow, a value obtained by subtracting the absolute value of the supply voltage SB from the absolute value of the blade voltage BB is |−150 V|−|−300 V|=−150 V.

Likewise, in the ID unit 4M for magenta, a value obtained by subtracting the absolute value of the supply voltage SB from the absolute value of the blade voltage BB is |−230 V|−|−380 V|=−150 V. In the ID unit 4C for cyan, a value obtained by subtracting the absolute value of the supply voltage SB from the absolute value of the blade voltage BB is |−150 V|−|−300 V|=−150 V.

That is to say, in the present embodiment, the value (+120 V) which is obtained by subtracting the absolute value of the supply voltage SB from the absolute value of the blade voltage BB in the ID unit 4W for white is larger than the value (−150 V) which is obtained by subtracting the absolute value of the supply voltage SB from the absolute value of the blade voltage BB in each of the other ID units 4K, 4Y, 4M, and 4C.

As described above, generation of fogging is remarkable in the toner (white toner) which contains a high content of a low-resistance material (or a conductive material). In the present embodiment, the value obtained by subtracting the absolute value of the supply voltage SB from the absolute value of the blade voltage BB in the ID unit 4W which uses the toner that is most easy to cause fogging is made larger than the value obtained by subtracting the absolute value of the supply voltage SB from the absolute value of the blade voltage BB in each of the other ID units 4K, 4Y, 4M, and 4C.

That is, in the present embodiment, in the ID unit 4W which uses the toner that is most easy to cause fogging (the toner which is hardest to be charged), by making the value obtained by subtracting the absolute value of the supply voltage SB from the absolute value of the blade voltage BB a large value, the fogging toner (oppositely charged toner or toner having a small charge amount) is normally charged. On the other hand, in each of the ID units 4K, 4Y, 4M, and 4C which uses the toner that is relatively hard to cause fogging, by making the blade voltage BB a small value, overcharging of the toner is suppressed.

As the method for suppressing fogging, there is also a method in which the value obtained by subtracting the absolute value of the developing voltage DB from the absolute value of the surface potential of the photosensitive drum 41W in the ID unit 4W is made smaller than that in each of the other ID units 4K, 4Y, 4M, and 4C (see, Patent Reference 1, for example). But, in this case, there is a possibility that color tone may change due to an environmental change or a temporal change. In the present embodiment, since it is not necessary to make the value obtained by subtracting the absolute value of the developing voltage DB from the absolute value of the surface potential of the photosensitive drum 41W small, a change of color tone is not also caused.

Although the description has been made about the white toner as an example of the toner which is easy to cause fogging (toner which is hard to be charged), the present invention is not limited to a case where the white toner is used. The present invention can be also applied, for example, to a case where toner (developer) which contains a high content of a conductive material or a low-resistance material, such as gold toner, silver toner, transparent toner, mica toner and UV toner (ultraviolet absorption toner), is used.

Effects of Embodiment

As described above, in the present embodiment, by making the absolute value of a voltage applied to the developing blade 45 (blade voltage BB) larger than the absolute value of a voltage applied to the supply roller 44 (supply voltage SB) in the ID unit 4 which uses the toner that is easy to cause fogging (e.g., the ID unit 4W), the fogging toner (oppositely charged toner and toner having a small charge amount) is normally charged, and therefore generation of fogging can be suppressed.

Moreover, by making the value obtained by subtracting the absolute value of the supply voltage SB from the absolute value of the blade voltage BB in the ID unit (e.g., the ID unit 4W) which uses the toner that is easy to cause fogging larger than the value obtained by subtracting the absolute value of the supply voltage SB from the absolute value of the blade voltage BB in each of the ID units (e.g., the ID units 4K, 4Y, 4M, and 4C) which uses the other toners, it is possible to suppress not only generation of fogging but also generation of smear by suppressing overcharging of the toner in the ID unit which is relatively hard to cause fogging.

Furthermore, by arranging the ID unit which uses the toner that is easy to cause fogging (e.g., the ID unit 4W) on the most downstream side in the direction of movement of the intermediate transfer belt 11, it is possible to suppress a decrease of the OD value of the toner image.

Modified Example

Next, a modified example of the first embodiment will be described. In the first embodiment described above, as shown in FIG. 1 and FIG. 10, the ID unit 4W which uses the toner that is easy to cause fogging is arranged on the most downstream side out of the ID units 4K, 4Y, 4M, 4C, and 4W in the direction of movement of the intermediate transfer belt 11. However, the ID unit (e.g., the ID unit 4W) which uses the toner that is easy to cause fogging is not necessarily arranged on the most downstream side.

For example, even in a case where the ID unit 4W is arranged on the most upstream side in the direction of movement of the intermediate transfer belt 11 as shown in FIG. 7, by making the absolute value of the blade voltage BB which is applied to the developing blade 45W larger than the absolute value of the supply voltage SB which is applied to the supply roller 44W in the ID unit 4W, the effect of normally charging the fogging toner and thereby suppressing generation of fogging is obtained.

Likewise, even in a case where the ID unit 4W is arranged in the second, third or fourth from the upstream side in the direction of movement of the intermediate transfer belt 11, by making the absolute value of the blade voltage BB which is applied to the developing blade 45W larger than the absolute value of the supply voltage SB which is applied to the supply roller 44W in the ID unit 4W, the effect of suppressing generation of fogging is obtained.

Moreover, although in the first embodiment, the description is given with respect to the printer 1 of the intermediate transfer system which uses the intermediate transfer belt 11, the present invention can be also applied to a printer of a direct transfer system.

Figure 15:
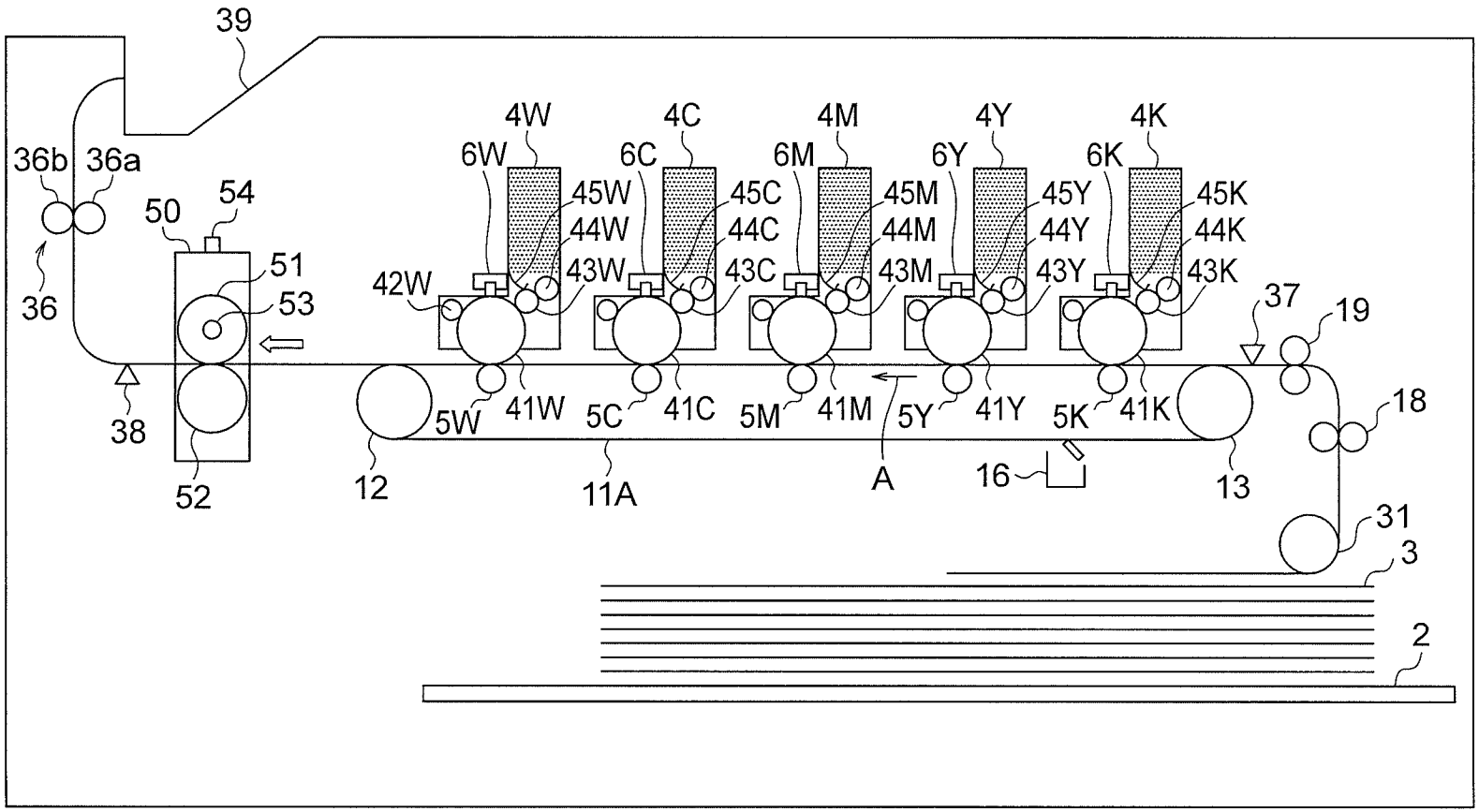
FIG. 15 is a diagram showing a configuration of a printer according to a modified example of the first embodiment.

FIG. 15 shows a configuration example of a printer 1A of a direct transfer system. The printer 1A shown in FIG. 15 includes a conveyance belt 11A instead of the intermediate transfer belt 11 (FIG. 1). The direction of movement of the conveyance belt 11A (arrow A) is opposite the direction of movement of the intermediate transfer belt 11 (FIG. 1). The ID units 4K, 4Y, 4M, 4C, and 4W are arranged from the right toward the left in FIG. 15, along a direction in which the recording medium 3 is conveyed by the conveyance belt 11A. The printer 1A does not include the secondary transfer roller 21 and the secondary transfer backup roller 14.

The recording medium 3 (transfer body) which is fed from the medium cassette 2 by the hopping roller 31 is conveyed to the conveyance belt 11A by the registration roller pair 18 and the conveyance roller pair 19. The conveyance belt 11A holds and adsorbs the recording medium 3, and conveys the recording medium 3 along the ID units 4K, 4Y, 4M, 4C, and 4W. Toner images on the photosensitive drums 41K, 41Y, 41M, 41C, and 41W in the ID units 4K, 4Y, 4M, 4C, and 4W are successively transferred onto the recording medium 3. The recording medium 3 is further conveyed to the fixing unit 50 by the conveyance belt 11A, so that the toner images are fixed onto the recording medium 3. The recording medium 3 onto which the toner images have been fixed is discharged from the printer 1A by the discharge roller pair 36.

Even with such a configuration, by making the absolute value of the blade voltage BB which is applied to the developing blade 45W larger than the absolute value of the supply voltage SB which is applied to the supply roller 44W in the ID unit 4W, it is possible to suppress generation of fogging.

The present invention can be applied not only to a printer but also to an image forming apparatus for forming an image by using an electrophotographic method, such as a copying machine, a facsimile machine and a multifunction machine.

DESCRIPTION OF REFERENCE CHARACTERS

1 printer (image forming apparatus); 2 medium cassette; 3 recording medium; 4, 4K, 4Y, 4M, 4C, 4W ID unit (image forming unit); 5 (5K, 5Y, 5M, 5C, 5W) primary transfer roller (primary transfer part); 6 (6K, 6Y, 6M, 6C, 6W) LED head (exposure part); 11 intermediate transfer belt; 41 (41K, 41Y, 41M, 41C, 41W) photosensitive drum (image carrier); 42 (42K, 42Y, 42M, 42C, 42W) charging roller (charging member); 43 (43K, 43Y, 43M, 43C, 43W) developing roller (developer carrier); 44 (44K, 44Y, 44M, 44C, 44W) supply roller (supply member); 45 (45K, 45Y, 45M, 45C, 45W) developing blade (developer regulating member); 46 (46K, 46Y, 46M, 46C, 46W) toner cartridge (developer container); 200 main controller; 210 CPU; 220 ROM; 221 ID unit arrangement table; 222 setting table; 300 process controller; 310 high-voltage controller; 311 charging voltage controller (charging voltage applying means); 312 developing voltage controller (developing voltage applying means); 313 supply voltage controller (supply voltage applying means); 314 blade voltage controller (developer-regulating-member voltage applying means); 315 transfer voltage controller; 320 exposure controller.

What is claimed is:

1. An image forming apparatus comprising a plurality of image forming units for forming developer images by using different kinds of developers, wherein each of the plurality of image forming units includes:

an image carrier for carrying an electrostatic latent image;

a developer carrier receiving and holding a developer out of the developers, the developer carrier for developing the electrostatic latent image of the image carrier with the developer;

a developer regulating member that regulates a thickness of a layer of the developer held by the developer carrier; and a supply member that supplies the developer to the developer carrier, wherein the image forming units include first and second image forming units, the first image forming unit forming one of the developer images by using a first developer which is a white developer, and the second image forming unit forming another of the developer images by using a second developer out of the developers which is different from the first developer, and further wherein a value, obtained by subtracting an absolute value of a voltage applied to the supply member of the first image forming unit from an absolute value of a voltage applied to the developer regulating member of the first image forming unit, is larger than a value obtained by subtracting an absolute value of a voltage applied to the supply member of the second image forming unit from an absolute value of a voltage applied to the developer regulating member of the second image forming unit, in the first image forming unit, the absolute value of the voltage applied to the developer regulating member is larger than the absolute value of the voltage applied to the supply member.

2. The image forming apparatus according to claim 1, wherein the voltage applied to the developer regulating member of the first image forming unit has the same polarity as a charge polarity of the first developer of the first image forming unit.

3. The image forming apparatus according to claim 1, wherein the first developer is a developer which contains a highest content of a conductive material out of the developers or a material having low-electrical resistance.

4. The image forming apparatus according to claim 1, wherein the plurality of image forming units are arranged from an upstream side toward a downstream side along a direction of movement of a transfer body; and the first image forming unit is arranged on a most downstream side in the direction of movement of the transfer body.

5. The image forming apparatus according to claim 1, further comprising an intermediate transfer belt which moves along the plurality of image forming units, wherein the plurality of image forming units are arranged from an upstream side toward a downstream side along a direction of movement of the intermediate transfer belt; and the first image forming unit is arranged on a most downstream side in the direction of movement of the intermediate transfer belt.

6. The image forming apparatus according to claim 4, further comprising a conveyance belt which moves along the plurality of image forming units, wherein the transfer body is a recording medium which is conveyed by the conveyance belt.

7. The image forming apparatus according to claim 1, wherein the second image forming unit forms the another developer image by using the second developer which has a color other than white.

8. The image forming apparatus according to claim 7, wherein the second image forming unit forms the another developer image by using at least one developer selected from the group consisting of a black developer, a yellow developer, a magenta developer, and a cyan developer.

9. The image forming apparatus according to claim 1, wherein in the second image forming unit, the absolute value of the voltage applied to the developer regulating member is smaller than the absolute value of the voltage applied to the supply member.

10. The image forming apparatus according to claim 1, wherein for each of the image forming units, the developer regulating member is a developing blade which is disposed so as to face the developer carrier.

11. An image forming apparatus comprising:

a first image forming unit that forms a first developer image by using a first developer other than a black developer, a yellow developer, a magenta developer and a cyan developer, a second image forming unit that forms a second developer image by using a second developer, the second developer being any of the black developer, the yellow developer, the magenta developer and the cyan developer, wherein:

the second image forming unit includes:

a second image carrier for carrying a second electrostatic latent image;

a second developer carrier receiving and holding the second developer, the second developer carrier for developing the second electrostatic latent image of the second image carrier with the second developer;

a second developer regulating member that regulates a thickness of a layer of the second developer held by the second developer carrier; and a second supply member that supplies the second developer to the second developer carrier, the first image forming unit includes:

a first image carrier for carrying a first electrostatic latent image;

a first developer carrier receiving and holding the first developer, the first developer carrier for developing the first electrostatic latent image of the first image carrier with the first developer;

a first developer regulating member that regulates a thickness of a layer of the first developer held by the first developer carrier; and a first supply member that supplies the first developer to the first developer carrier, a value obtained by subtracting an absolute value of a voltage applied to the first supply member from an absolute value of a voltage applied to the first developer regulating member is larger than a value obtained by subtracting an absolute value of a voltage applied to the second supply member from an absolute value of a voltage applied to the second developer regulating member.

12. The image forming apparatus according to claim 11, wherein the first developer is any one of a gold developer, a silver developer, a transparent developer, a mica developer and an ultraviolet absorption (UV) developer.

13. The image forming apparatus according to claim 11, wherein the voltage applied to the second developer regulating member, the voltage applied to the first developer regulating member, the voltage applied to the second supply member and the voltage applied to the first supply member are all the same polarity.

14. The image forming apparatus according to claim 11, wherein the absolute value of the voltage applied to the first developer regulating member is larger than the absolute value of the voltage applied to the first supply member.

15. The image forming apparatus according to claim 14, wherein the absolute value of the voltage applied to the second developer regulating member is smaller than the absolute value of the voltage applied to the second supply member.

16. The image forming apparatus according to claim 14, wherein the absolute value of the voltage applied to the first supply member is larger than the absolute value of the voltage applied to the second supply member.

17. The image forming apparatus according to claim 14, wherein the absolute value of the voltage applied to the first developer regulating member is larger than the absolute value of the voltage applied to the second developer regulating member.

* * * * *